US009194647B2

(12) United States Patent
Maeda

(10) Patent No.: US 9,194,647 B2
(45) Date of Patent: Nov. 24, 2015

(54) TOY GUN AND TOY GUN GAS CARTRIDGE LOADING DEVICE

(71) Applicant: Maruzen Company Limited, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 14/156,075

(22) Filed: Jan. 15, 2014

(65) Prior Publication Data

US 2014/0290637 A1 Oct. 2, 2014

(30) Foreign Application Priority Data

Apr. 2, 2013 (JP) ..... 2013-77284

(51) Int. Cl.
*F41B 11/56* (2013.01)
*F41B 11/62* (2013.01)
*F41A 17/38* (2006.01)

(52) U.S. Cl.
CPC ..... *F41B 11/62* (2013.01); *F41A 17/38* (2013.01); *F41B 11/56* (2013.01)

(58) Field of Classification Search
CPC ..... F41B 11/00; F41B 11/50; F41B 11/51; F41B 11/56; F41B 11/60; F41B 11/62; F41B 11/70; F41B 11/89
See application file for complete search history.

(56) References Cited

U.S. PATENT DOCUMENTS

| | | | | |
|---|---|---|---|---|
| 6,470,872 | B1 | 10/2002 | Tiberius et al. | |
| 6,810,870 | B1 * | 11/2004 | Hu | 124/76 |
| 7,273,047 | B2 * | 9/2007 | Hu | 124/74 |
| 2004/0200466 | A1 * | 10/2004 | Salva | 124/74 |
| 2006/0201491 | A1 * | 9/2006 | Wei | 124/74 |
| 2008/0168973 | A1 * | 7/2008 | Levin et al. | 124/73 |
| 2014/0338650 | A1 * | 11/2014 | Maeda | 124/74 |
| 2015/0007804 | A1 * | 1/2015 | Tippmann et al. | 124/73 |

FOREIGN PATENT DOCUMENTS

| | | | |
|---|---|---|---|
| CH | 704013 | A2 | 4/2012 |
| JP | 2012-042116 | A | 3/2012 |

(Continued)

OTHER PUBLICATIONS

The Extended European Search Report in Application No. 13004520.6, mailed Nov. 19, 2013.

(Continued)

*Primary Examiner* — Bret Hayes
*Assistant Examiner* — Derrick Morgan
(74) *Attorney, Agent, or Firm* — Michael Best & Friedrich LLP

(57) ABSTRACT

A toy gun includes a toy gun body and a toy gun gas cartridge loading device. The toy gun body includes a housing, a gun body first lock and a gun body second lock. The gas cartridge loading device is detachably housed in the housing and is locked with the gun body first lock. The gas cartridge loading device includes a loading device second lock which is housed in the loading device housing when an end of the gas cartridge loading device is housed in the housing. The loading device second lock is located on a lateral side of the gas cartridge loading device. When the gun body first lock is disengaged, the loading device second lock engages with a gun body second lock.

2 Claims, 19 Drawing Sheets

(56) References Cited

FOREIGN PATENT DOCUMENTS

| | | | |
|---|---|---|---|
| TW | M249004 | U | 11/2004 |
| TW | 201331545 | A | 8/2013 |

OTHER PUBLICATIONS

IPO Search Report issued in Taiwanese Patent Application No. 102133527, dated Mar. 3, 2015.

* cited by examiner

TOY GUN AND TOY GUN GAS CARTRIDGE LOADING DEVICE

CROSS-REFERENCE TO RELATED APPLICATION(S)

This application is based upon and claims the benefit of priority from Japanese Patent Application JP2013-077284, filed on Apr. 2, 2013, the entire disclosure of which is incorporated herein by reference.

TECHNICAL FIELD

The present invention relates to a toy gun and a loading device for a toy gun. More particularly the invention relates to a toy gun to which a gas cartridge can be attached to fire a bullet by the pressure of compressed gas in the gas cartridge, and a toy gun gas cartridge loading device for loading a gas cartridge on the toy gun.

BACKGROUND ART

In some of the air guns which fire a bullet using compressed gas such as $CO_2$ gas, an attachable/detachable toy gun gas cartridge loading device (puncture unit) is attached to the gun body with a gas cylinder housed in the loading device.

This type of air gun is more advantageous than a toy gun with a gas cylinder housed directly in the gun body in the sense that it is easier to cope with change in the gas which may be caused by firing. The reason is as follows. Generally, in an air gun which uses compressed gas as an energy source, the gas becomes cool after firing. When the gas becomes cool, the expansion force of the gas weakens and the following problem arises: the bullet speed drops or in the case of a blowback toy gas gun, the gun fails to work normally, for example, a blowback failure occurs.

In a toy gun in which a gas cylinder is housed directly in the gun body, it is difficult to warm up the gas which has been once used and become cool without taking a measure to warm the toy gun such as putting it in a warm place.

A toy gun which uses an attachable/detachable toy gun gas cartridge loading device is more convenient because the user can restart using the gun immediately after replacement of the toy gun gas cartridge loading device.

In the case of a toy gun in which two gas cylinders are housed directly in the gun body, it is troublesome that the user has to replace the gas cylinders one by one.

On the other hand, a toy gun that uses a toy gun gas cartridge loading device is more convenient in the sense that even when the air gun uses two gas cylinders, the user has only to replace a single puncture unit upon replacement of the gas cylinders.

There are two types of toy air gun which use a toy gun gas cartridge loading device: in one type, a valve to fire a bullet is built in the gas cartridge loading device and in the other type, the gas cartridge loading device does not have such a valve.

In the latter type of air gun, the toy gun gas cartridge loading device is attached to the toy gun body, so that the gas in the gas cylinder of the gas cartridge loading device flows into the air chamber of the toy gun body. As the user pulls the trigger to fire a bullet, a discharge valve opens and gas rapidly flows out of the air chamber to fire the bullet. The present invention concerns an air gun which uses the above toy gun gas cartridge loading device and has a valve built in the toy gun body.

An example of a toy gun gas cartridge loading device of this type in the related art is disclosed in JP-A-2012-42116 entitled TOY GUN AND LOADING DEVICE. It is described as follows: "An air chamber body 122 located in a toy gun forms an air chamber 126. The compressed gas in the air chamber body 122 passes through a gas discharge part to fire a bullet held in a bullet holder from a muzzle. A valve opens and closes the communication between the air chamber body 122 and the gas discharge part according to operation of an operating part. The toy gun includes a plurality of gas cartridge holders 210. Gas cylinders 102 are loaded in the gas cartridge holders 210. Each gas cartridge holder 210 has a first valve. The compressed gas in the gas cylinder 102 loaded in the gas cartridge holder 210 is passed through a gas introduction part 301 and introduced into the air chamber 126."

However, when the toy gun gas cartridge loading device is detached from the gun for replacement, etc., if there is residual compressed gas in the air chamber of the toy gun body, the gas is going to flow out rapidly, so the toy gun gas cartridge loading device may jump out of the toy gun body. Therefore, in order to prevent the toy gun gas cartridge loading device from jumping out in this way, a toy gun in the related art has a double-step mechanism to detach the toy gun gas cartridge loading device from the toy gun body as mentioned below.

The double-step mechanism in the related art is as shown in FIGS. 16 to 21. FIG. 16 is a fragmentary enlarged view of a toy gun gas cartridge loading device attached to a toy gun in the related art and its vicinity; FIG. 17 is a sectional view of the toy gun gas cartridge loading device in the related art; FIG. 18 is a fragmentary enlarged view of the toy gun gas cartridge loading device in the related art and its vicinity, in which the toy gun gas cartridge loading device is being detached from the toy gun with a second puncture catch engaged with the toy gun gas cartridge loading device; FIG. 19 is a left side view of the toy gun in the related art; FIG. 20 is a left side view of a real gun on which the toy gun in the related art is based; and FIG. 21 is a perspective back view of the toy gun in the related art with the toy gun gas cartridge loading device detached.

In this related art technique, a reference numeral 101 denotes a toy gun body and 102 denotes a valve. As shown in FIGS. 16 and 18, the valve 102 is fixed in the gun body 101. A reference numeral 111 denotes a toy gun gas cartridge loading device (puncture unit) which houses two gas cylinders 112.

A member which cancels the engagement between the valve 102 and the toy gun gas cartridge loading device 111 is referred to as a first lock (puncture catch) 113 and a member which once locks the toy gun gas cartridge loading device 111 is referred to as a second lock (second puncture catch) 114.

A fixing groove 115 is provided on a lateral side of the toy gun gas cartridge loading device 111. As the toy gun gas cartridge loading device 111 begins to disengage, a puncture catch lock 116 attached to the tip of the first lock 113 of the toy gun body 101 fits in the fixing groove 115, so that the toy gun gas cartridge loading device 111 is once locked and fixed (FIG. 18).

By pushing down the first lock 113 located in the loading device housing 103 of the toy gun body 101, the first lock 113 is turned and the toy gun gas cartridge loading device 111 is disengaged from the first lock (puncture catch) 113.

At this moment, the toy gun gas cartridge loading device (puncture unit) 111 is going to be released from the toy gun body 101 by the pressure of the gas in the air chamber of the toy gun body 101 but the puncture catch lock 116 at the tip of the second lock 114 fits into the fixing groove 115 of the toy gun gas cartridge loading device 111.

The gas in the air chamber is passed through the space between the toy gun gas cartridge loading device 111 and the air chamber 104 and forced out of the toy gun body 101.

Then, by pushing down the second lock 114, the toy gun gas cartridge loading device 111 and the second lock 114 are disengaged from each other and as shown in FIG. 19, the toy gun gas cartridge loading device 111 can be removed safely.

In other words, the double-step mechanism to detach the toy gun gas cartridge loading device 111 from the toy gun body 101 includes the following steps as shown in FIGS. 16 to 21.

(1) Immediately after the valve 102 in the toy gun body 101 and the first lock 113 of the toy gun gas cartridge loading device 111 are disengaged from each other, the toy gun gas cartridge loading device 111 is once locked by the second lock 114 as another lock member provided on the toy gun body 101.

As a consequence, the gas in the air chamber of the toy gun body 101 flows out of the toy gun body 101, thereby eliminating the possibility that the toy gun gas cartridge loading device 111 might jump out.

(2) The user unlocks the toy gun gas cartridge loading device 111 from the second lock 114 and removes the toy gun gas cartridge loading device 111 from the toy gun body 101.

SUMMARY OF THE INVENTION

Technical Problem

However, the related art technique illustrated in FIGS. 16 to 21 has the following problem.

In many cases, an air gun as a toy gun is manufactured in imitation of the design of a real charge gun. The commercial value of such an air gun is determined according to the degree of similarity to the real gun design. However, in the above gun in the related art, the loading device housing 103 which corresponds to the inserted detachable magazine of the real gun is integrated with the toy gun body 101 as shown in FIG. 19.

For this reason, when the toy gun gas cartridge loading device 111 is removed, the loading device housing 103, as a cover-shaped member in which the second lock 114 is located, remains integral with the toy gun body 101, posing the problem that its similarity to the real gun design is low and its design value as an air gun is impaired.

As shown in FIG. 20 as a left side view of a real gun 121 on which the toy gun in the related art is based, 122 denotes a cartridge which is attached to, or detached from, the real gun 121 charged with real bullets. When the cartridge 122 is detached from the real gun 121, the portion of the real gun 121 to which the cartridge 122 was attached is free of protrusions, and is flat.

In addition, the operating part of the first lock (puncture catch) 113 and the operating part of the second lock 114 are operated outside of the toy gun body 101 and exposed as shown in FIG. 21, posing a similar problem.

An object of the present invention is to provide a means to prevent a toy gun gas cartridge loading device (puncture unit) from jumping out of a toy gun body when detaching the toy gun gas cartridge loading device from the gun for replacement, etc., while maintaining similarity to a real gun design.

Solution to Problem

A toy gun of the present invention comprises a toy gun body and a toy gun gas cartridge loading device to be attached to the toy gun body, wherein the toy gun body comprising:

a gun body coupling valve for introducing compressed gas from outside and supplying the compressed gas into the toy gun body;

a loading device housing located around the gun body coupling valve;

a gun body first lock being located on an upper portion of the loading device housing and locked with the toy gun gas cartridge loading device when a toy gun side end of the toy gun gas cartridge loading device is inserted through an opening of the loading device housing for attachment to the toy gun body; and a gun body second lock being located under the gun body first lock, the toy gun gas cartridge loading device, housed in the loading device housing of the toy gun body when attached to the toy gun body, comprising:

a gas cartridge housed therein;

a loading device coupling valve being located at a tip of the toy gun gas cartridge loading device and coupled to the gun body coupling valve of the toy gun body for attachment to the toy gun body; and a loading device second lock being housed in the loading device housing when the end of the toy gun gas cartridge loading device is housed in the loading device housing of the toy gun body, and located on a lateral side of the toy gun gas cartridge loading device and under a part engaging with the gun body first lock and designed to be locked with the gun body second lock.

A toy gun gas cartridge loading device of the present invention is housed in a loading device housing of a toy gun body when attached to the toy gun body and houses a gas cartridge, comprising:

a loading device coupling valve being located at a tip of the toy gun gas cartridge loading device and coupled to a gun body coupling valve of the toy gun body for attachment to the toy gun body; and a loading device second lock being housed in the loading device housing when the end of the toy gun gas cartridge loading device is housed in the loading device housing of the toy gun body, and located on a lateral side of the toy gun gas cartridge loading device and under a part engaging with a gun body first lock and designed to be locked with a gun body second lock.

Advantageous Effects of the Invention

According to the present invention, even when the gun body first lock which locks the toy gun gas cartridge loading device is unlocked, the gun body second lock and the loading device second lock are locked with each other.

Therefore, the invention provides a means to prevent the toy gun gas cartridge loading device from jumping out of the toy gun body when detaching the toy gun gas cartridge loading device from the gun for replacement, etc.

Even in some real guns, a housing for holding a charged cartridge is provided on a muzzle side of a trigger guard portion, so the toy gun according to the invention does not look dissimilar to a real gun.

DETAILED DESCRIPTION OF THE PREFERRED EMBODIMENTS

Next, a preferred embodiment of the present invention will be described referring to FIGS. 1 to 15 which illustrate the embodiment.

A toy gun 11 according to the present invention includes a toy gun body 12 and a toy gun gas cartridge loading device 41 to be attached to the toy gun body 12. The toy gun body 12 includes toy gun body side panels 12A and 12B which form both the lateral sides of the toy gun body 12.

Figure 1:
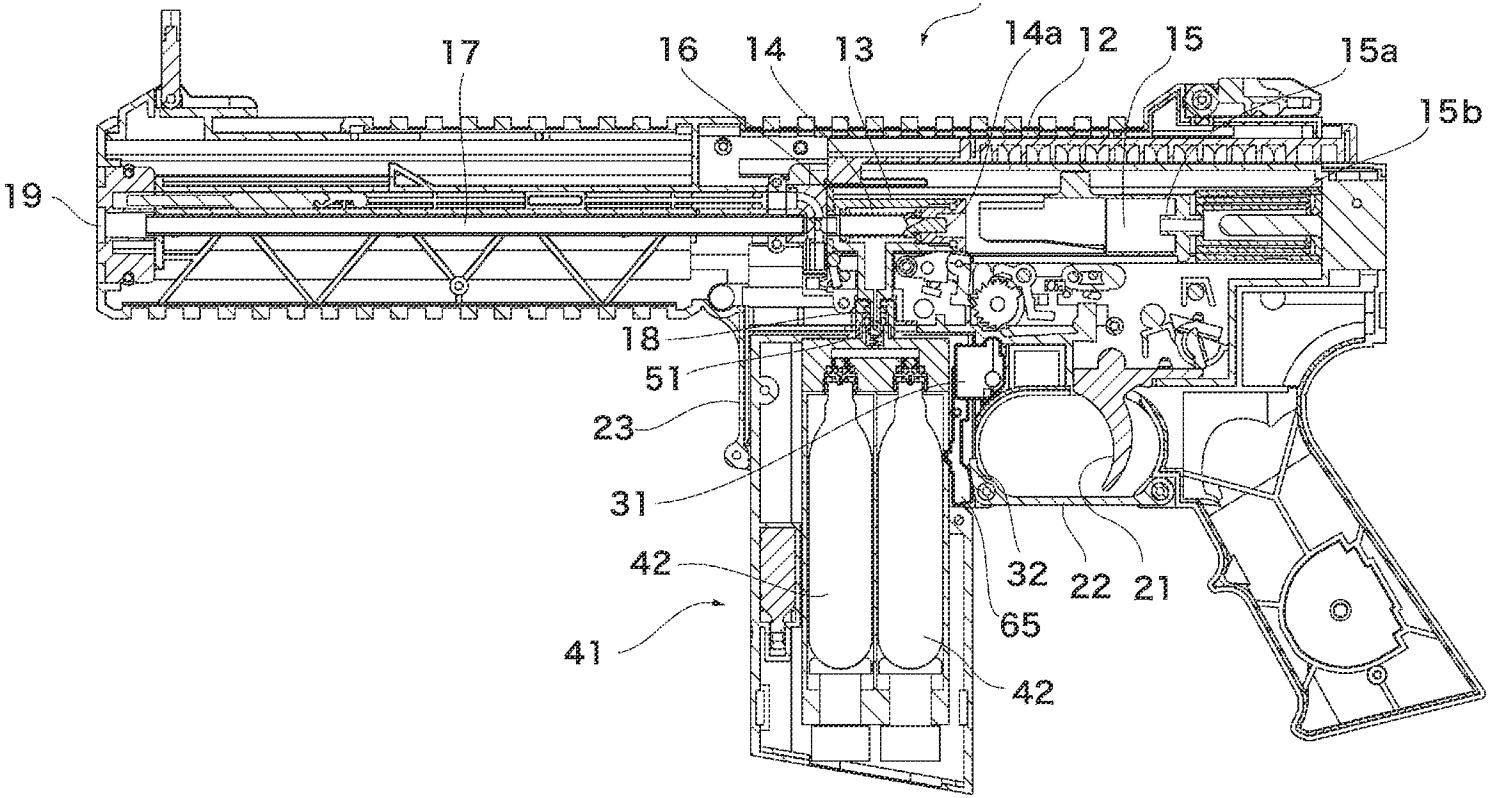
FIG. 1 is a left side sectional view of a toy gun gas cartridge loading device attached to a toy gun body according to an embodiment of the present invention.
Figure 2:
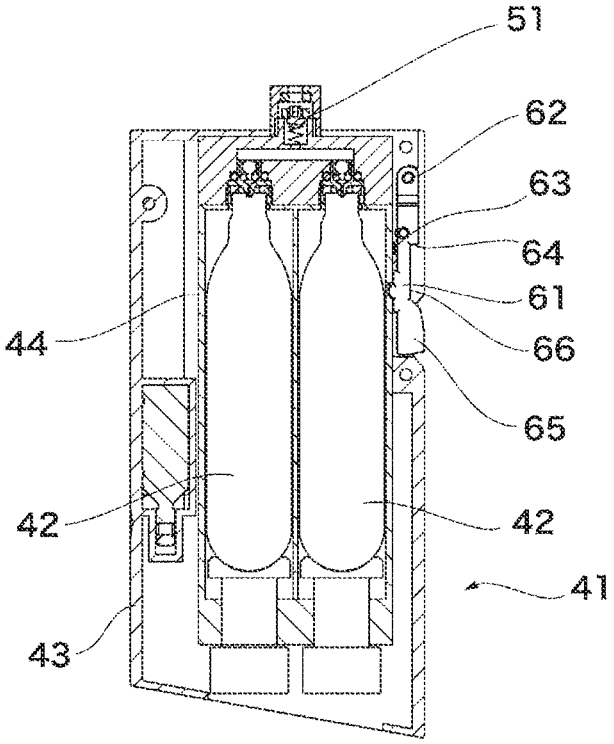
FIG. 2 is a fragmentary left side sectional view of the toy gun gas cartridge loading device according to the embodiment.
Figure 3:
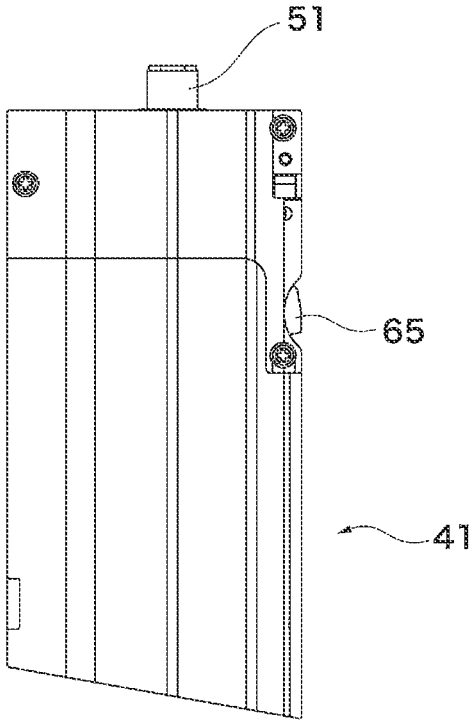
FIG. 3 is a left side view of the toy gun gas cartridge loading device according to the embodiment.

As shown in FIG. 1, inside the toy gun body side panels 12A and 12B, the toy gun body 12 has an air chamber 13, a valve 14 located inside the air chamber 13, a tubular bolt 15 which extends behind the valve 14 in the longitudinal direction of the toy gun 11 and is movable in the longitudinal direction of the gun barrel, and so on.

In the figure, a reference numeral 21 denotes a trigger and 22 denotes a trigger guard. The trigger guard 22 includes a lower side portion, and arranged around a lower side portion and a forward side (muzzle side) portion in which the trigger is not covered by the toy gun body 12 and is exposed to the surroundings.

As the user pulls the trigger 21, the bolt 15 begins moving forward and reciprocates between the pushing position and the retracted position by a bolt spring 15*b* and the pressure of the compressed gas supplied from the valve 14. A reference numeral 15*a* denotes a contact part.

A barrel 17 is located nearer to the muzzle 19 than the valve 14 with a gas discharge part 16 between the valve and the muzzle. As the compressed gas supplied from the valve 14 passes in the barrel, a bullet is moved toward the muzzle 19 in the barrel 17 and fired.

A reference numeral 18 denotes a gun body coupling valve. The gun body coupling valve 18 is comprised of a nozzle located under the valve 14 and coupled to the valve 14. The gun body coupling valve 18 introduces compressed gas from the toy gun gas cartridge loading device 41 and supplies the compressed gas to the valve 14 in the toy gun body 12.

A reference numeral 23 denotes a loading device housing. The loading device housing 23, located adjacent to the forward side of the trigger guard 22 around the gun body coupling valve 18, has a cylindrical form with an opening at its lower end, extending down to the lower side of the trigger guard 22. The loading device housing 23 is integral with the forward portion of the trigger guard 22.

A reference numeral 31 denotes a gun body first lock (puncture catch). As shown in FIG. 1, the gun body first lock 31 is located on the trigger 21 side upper portion of the loading device housing 23. The tip of the gun body first lock 31 is directed toward the inside of the loading device housing 23.

The gun body first lock 31 locks the toy gun gas cartridge loading device 41 when the toy gun 11 side end of the toy gun gas cartridge loading device 41 is inserted through the opening of the loading device housing 23 and attached to the toy gun body 12.

A reference numeral 32 denotes a gun body second lock (second puncture catch lock). The gun body second lock 32 is located under the gun body first lock 31 on the lower edge muzzle 19 side end of the trigger guard 22 with its tip directed toward the inside of the loading device housing 23.

In this embodiment, since the loading device housing 23 is integral with the trigger guard 22, so the gun body second lock 32 is located on the lower edge muzzle 19 side end of the trigger guard.

Figure 4:
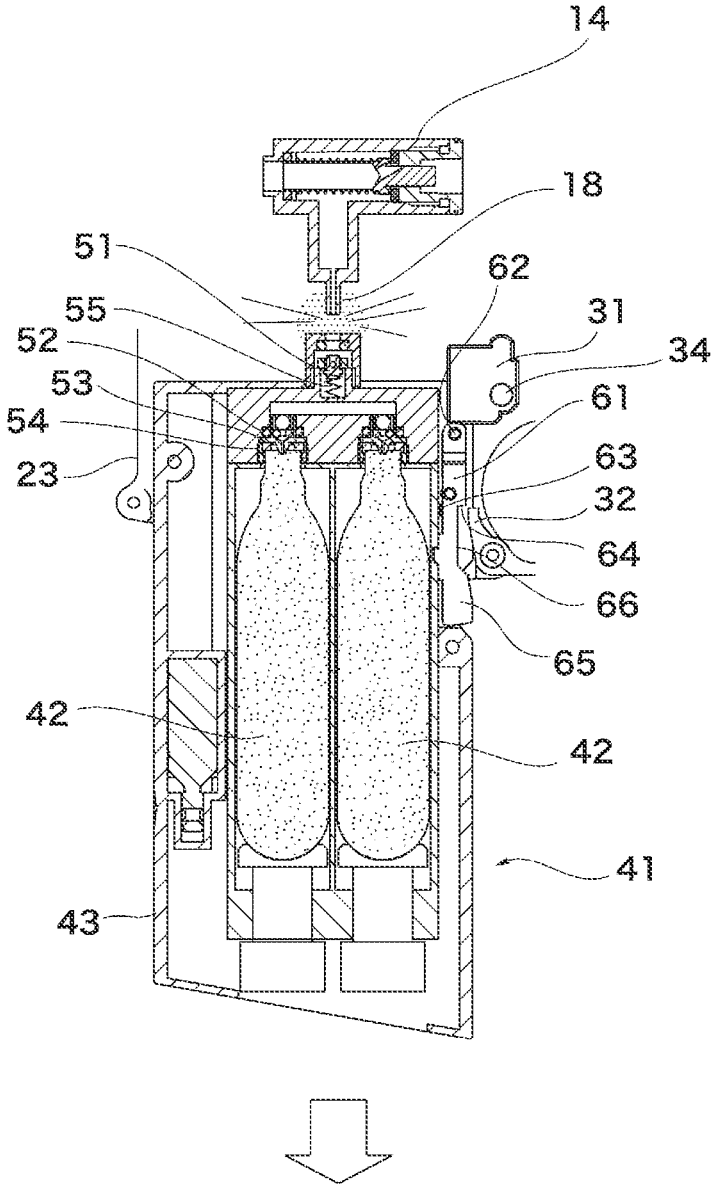
FIG. 4 is a left side sectional view of the toy gun gas cartridge loading device according to the embodiment, showing that the device attached to the toy gun body is being detached from the toy gun body.

The gun body second lock 32 is, as a whole, a roughly L-shaped member whose forward portion protrudes upward and toward the loading device housing 23 as shown in FIGS. 1 and 4.

The loading device housing 23 side upper end of the gun body second lock 32 is locked with a secondary lock 64 of a gun body lock concave part 66 provided on the loading device second lock (second puncture catch) 61 of the toy gun gas cartridge loading device 41.

When the toy gun gas cartridge loading device 41 is attached to the toy gun 11, the gun body second lock 32 is hidden behind the toy gun body 12.

A reference numeral 41 denotes a toy gun gas cartridge loading device 41 (puncture unit).

FIG. 1 shows that the toy gun gas cartridge loading device 41 is attached to the toy gun body 12, namely the toy gun gas cartridge loading device 41 is in a static state. In this embodiment, the toy gun gas cartridge loading device 41 houses two gas cartridges 42.

While it houses two gas cartridges 42 in this embodiment, only one cartridge or more than two cartridges may be housed.

The toy gun gas cartridge loading device 41 has a frame (puncture frame) 44 for loading gas cartridges 42 in an outer case 43 and the gas cartridges 42 are housed in the frame.

When the toy gun gas cartridge loading device 41 is attached to the toy gun body 12, the toy gun side end of the device is housed in the loading device housing 23 of the toy gun body.

A reference numeral 51 denotes a loading device coupling valve. The loading device coupling valve 51 is provided at the tip of the toy gun gas cartridge loading device 41 and when attaching to the toy gun body 12, the coupling valve 51 is coupled to the gun body coupling valve 18 of the toy gun body 12.

Reference numerals 52, 53, and 54 denote a packing, a cylinder unsealing part, and a packing, respectively. A reference numeral 55 denotes a loading device coupling valve spring which biases the loading device coupling valve 51 to close the valve.

A reference numeral 61 denotes a loading device second lock (second puncture catch). The loading device second lock (second puncture catch) 61 is located on a lateral side of the toy gun gas cartridge loading device 41. As shown in FIG. 1, when the end of the toy gun gas cartridge loading device 41 is housed in the loading device housing 23 of the toy gun body 12, the loading device second lock 61 is housed in the loading device housing 23 and invisible from outside. Furthermore, the loading device second lock 61 is located on the lateral side of the toy gun gas cartridge loading device 41 and under the engagement with the gun body first lock 31 and is designed to be locked with the gun body second lock 32.

The loading device second lock 61 is comprised of a lever-shaped member. A reference numeral 62 denotes a second lock turning shaft which is located on the lateral side of the toy gun gas cartridge loading device 41. The loading device second lock 61 turns on the second lock turning shaft 62.

A second lock spring 63 is located almost in the center of the loading device second lock 61 between the loading device second lock 61 and the puncture frame 44. The second lock spring 63 biases the second lock 61 counterclockwise as seen in the figures so that it turns on the second lock turning shaft 62 as an axis of rotation.

A secondary lock (puncture frame lock projection) 64 is provided under the second lock spring 63 for the loading device second lock 61. A second lock operating part 65 is provided under it. A gun body lock concave part 66 of the loading device second lock 61 lies between the upper portion of the second lock operating part 65 and the second lock 64, in which the concave part 66 is a lateral concave inward recess in the toy gun gas cartridge loading device 41. The second lock 64 corresponds to the upper inner side of the gun body lock concave part 66 as a lateral concave inward recess in the toy gun gas cartridge loading device 41.

While the second lock 114 is located on the toy gun body in the related art, in this embodiment the second lock 114 is located on the toy gun gas cartridge loading device 41 and the gun body second lock 32 is located on the toy gun body 12.

The bolt 15 can move forward and backward freely in the barrel (passage) 17. As the user pulls the trigger 21, the bolt 15 begins moving forward and reciprocates between the pushing position and the retracted position by the bolt spring and compressed gas pressure.

As the bolt 15 moves forward and reaches the pushing position, the rear peripheral part of the air chamber body fits the opening end of the bolt 15. As the bolt 15 further moves forward, the contact part 15*a* pushes forward the sliding boss 14*a* of the valve protruding in the fitting hole. This makes the valve 14 slide forward and opens the communication between the passage (barrel) 17 and the air chamber 13.

As the communication between the passage 17 and the air chamber 13 is opened, the compressed gas in the air chamber 13 flows into the passage 17 and pushes the back of the bullet held in the bullet holder. As a consequence, the bullet flies out of the muzzle. The valve 14 opens or closes the communication between the air chamber 13 and the gas discharge part 16.

When the communication between the passage 17 and the air chamber 13 is opened, the compressed gas pushes the contact part 15*a* backward. Consequently the bolt 15 begins moving backward and reaches the retracted position. The bolt 15 which has reached the retracted position is pushed by the bolt spring 15*b* and moves forward again. Then, when the bolt 15 reaches the pushing position, it pushes the sliding boss 14*a* of the valve 14 forward. In this way the bolt 15 moves forward and backward repeatedly or makes reciprocating movement. During a single reciprocal movement, the bolt 15 contacts and leaves the valve 14 to open and close the communication between the passage 17 and the air chamber 13.

As the contact part 15*a* leaves the sliding boss 14*a*, the valve spring pushes the valve 14 backward. Consequently the valve 14 slides backward, thereby closing the communication between the passage 17 and the air chamber 13. Then, the air chamber 13 is filled with compressed gas supplied from the gas introduction path.

The gun according to the present invention may be a fully automatic gun which continues to fire bullets while the trigger is held pulled or it may be any of the following types:

(1) a semiautomatic gun which fires one bullet when the trigger is pulled; and (2) a burst shooting gun which fires several bullets when the trigger is pulled.

How components other than the bolt 15 work depend on the type of gun.

Next, how this embodiment of the present invention functions will be described referring to drawings.

While the toy gun gas cartridge loading device 41 is attached to the toy gun body 12, as shown in FIG. 1 the gun body first lock 31 and the lateral side of the toy gun gas cartridge loading device 41 engage with each other by being pushed and the toy gun gas cartridge loading device 41 and the toy gun body 12 are locked with each other.

FIG. 4 is a sectional view which shows the moment the toy gun gas cartridge loading device 41 slightly moves down after the lateral side of the toy gun gas cartridge loading device 41 is disengaged from the gun body first lock 31 by operating the gun body first lock 31 of the toy gun body 12 in order to detach the toy gun gas cartridge loading device 41 from the toy gun body 12.

As the lateral side of the toy gun gas cartridge loading device 41 is disengaged from the gun body first lock 31, the residual gas in the valve 14 is released and due to its pressure, the toy gun gas cartridge loading device 41 moves down as shown in FIG. 4. At this time, the loading device second lock 61 begins turning counterclockwise by the biasing force of the second lock spring 63.

Figure 7:
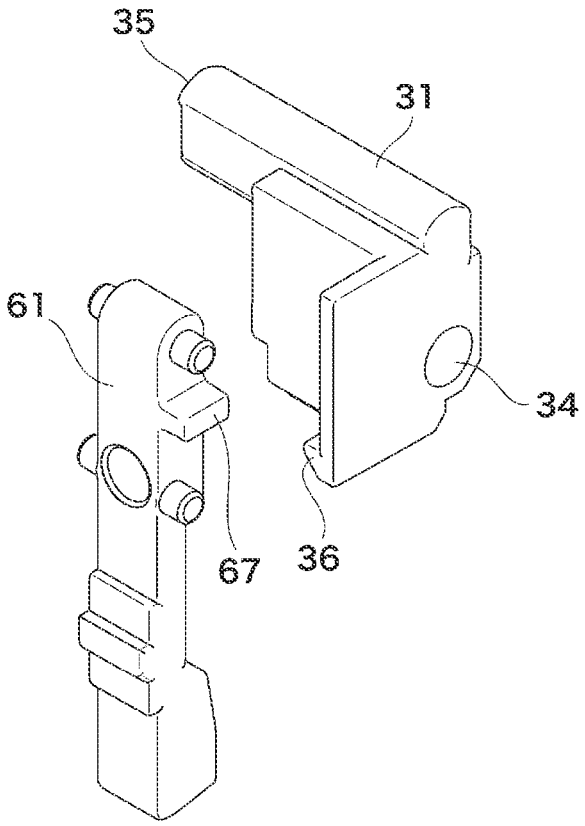
FIG. 7 is a fragmentary enlarged perspective view showing the relation between a gun body first lock and a loading device second lock according to the embodiment.

Next, how the loading device second lock (second puncture catch) 61 and the gun body first lock 31 which have engaged with each other disengage from each other will be described referring to FIGS. 7 to 11, in which FIG. 7 is a perspective view showing the gun body first lock 31 and the loading device second lock 61 and FIGS. 8 to 11 are fragmentary sectional back views showing the gun body first lock 31 and the loading device second lock 61.

Figure 8:
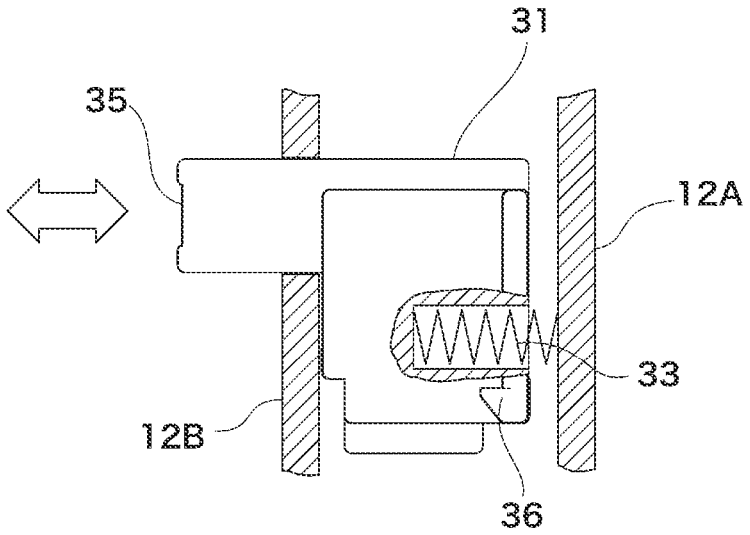
FIG. 8 is a fragmentary enlarged sectional view of the gun body first lock not locked with the loading device second lock, showing the relation between the gun body first lock and the loading device second lock according to the embodiment.

As shown in FIG. 7, the gun body first lock 31 is a roughly L-shaped member when seen from above and is biased by the first lock (puncture catch) spring 33. One end of the first lock spring 33 is housed in a spring housing 34 provided in the gun body first lock 31 and the other end is fixed on the toy gun body side panel 12A as illustrated in FIG. 8 which shows a cross section of the gun body first lock 31 not engaged with the loading device second lock 61.

Then, the gun body first lock 31 moves parallelly in the transverse direction of the gun. The gun body first lock 31 and the loading device second lock 61 engage with each other in a static state.

The gun body first lock 31 extends between the toy gun body side panels 12A and 12B.

Figure 15:
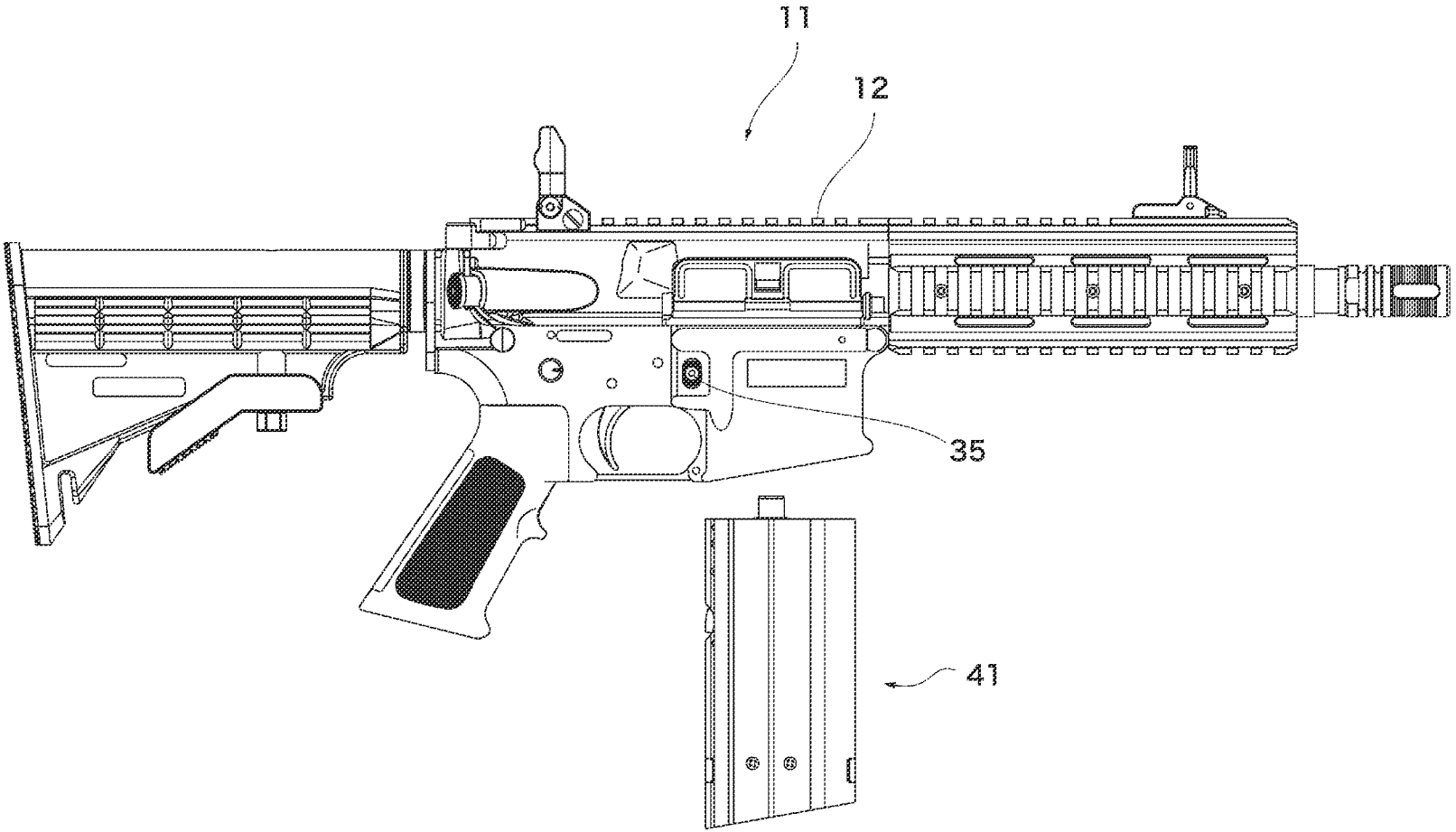
FIG. 15 is a right side view of the toy gun gas cartridge loading device detached from the toy gun body according to the embodiment.
Figure 16:
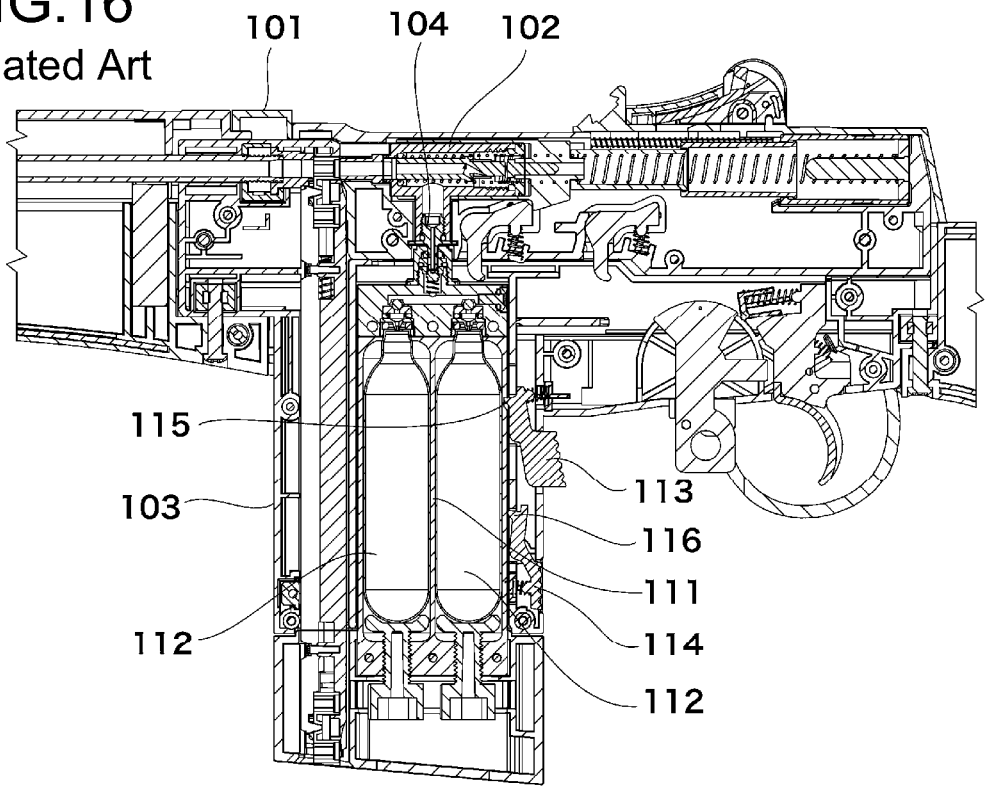
FIG.16 Related Art
FIG. 16 is a fragmentary enlarged left side view of a toy gun in the related art.
Figure 17:
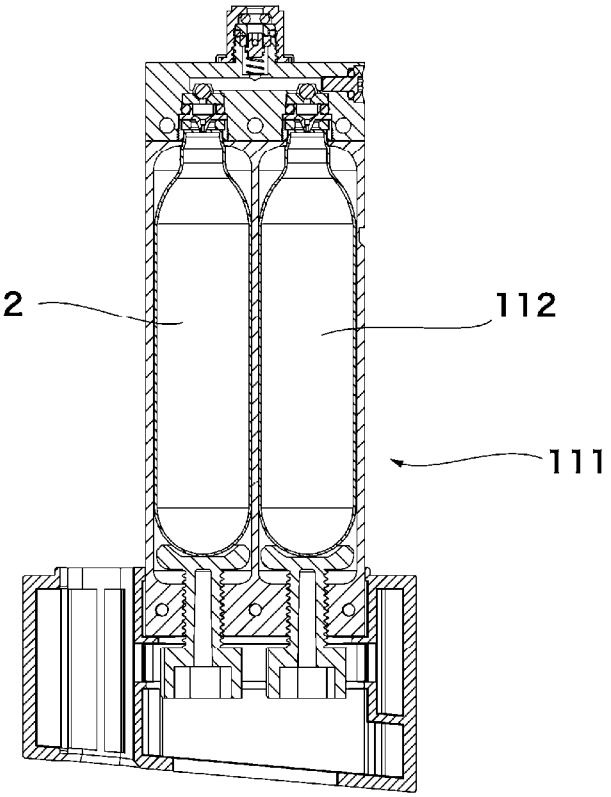
FIG.17 Related Art
FIG. 17 is a left side sectional view of a toy gun gas cartridge loading device in the related art.
Figure 18:
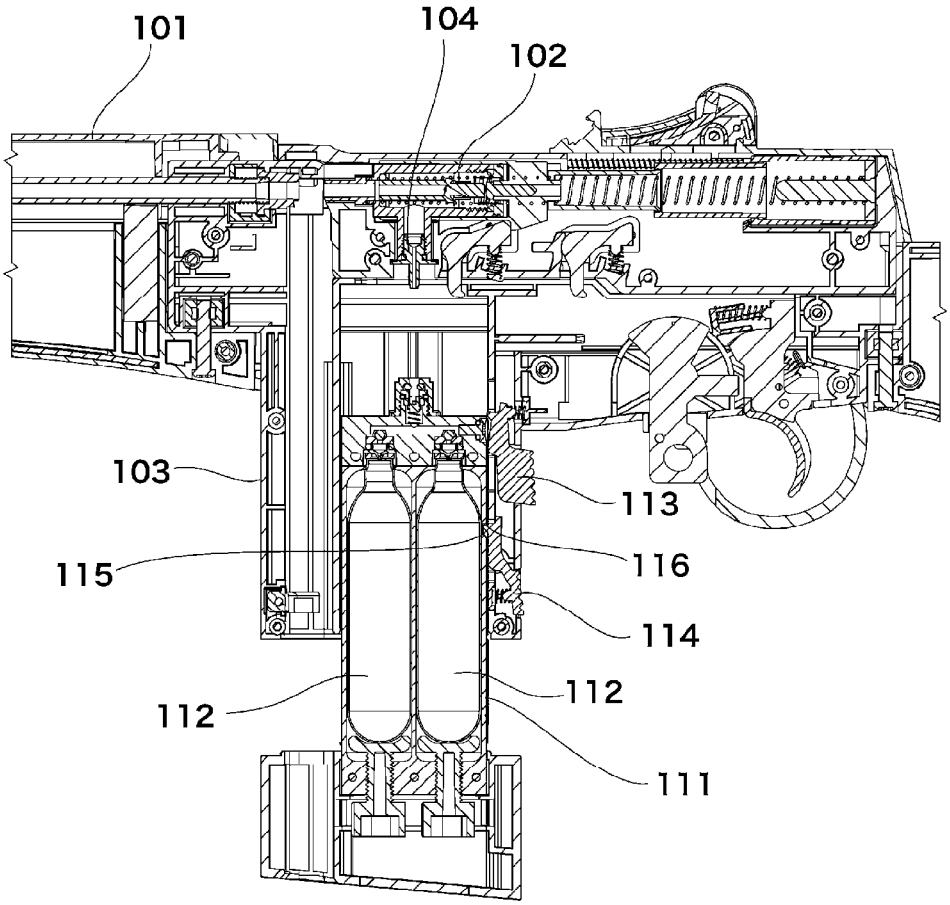
FIG.18 Related Art
FIG. 18 is a fragmentary enlarged view of the toy gun in which the toy gun gas cartridge loading device attached to the toy gun body in the related art is being detached.
Figure 19:
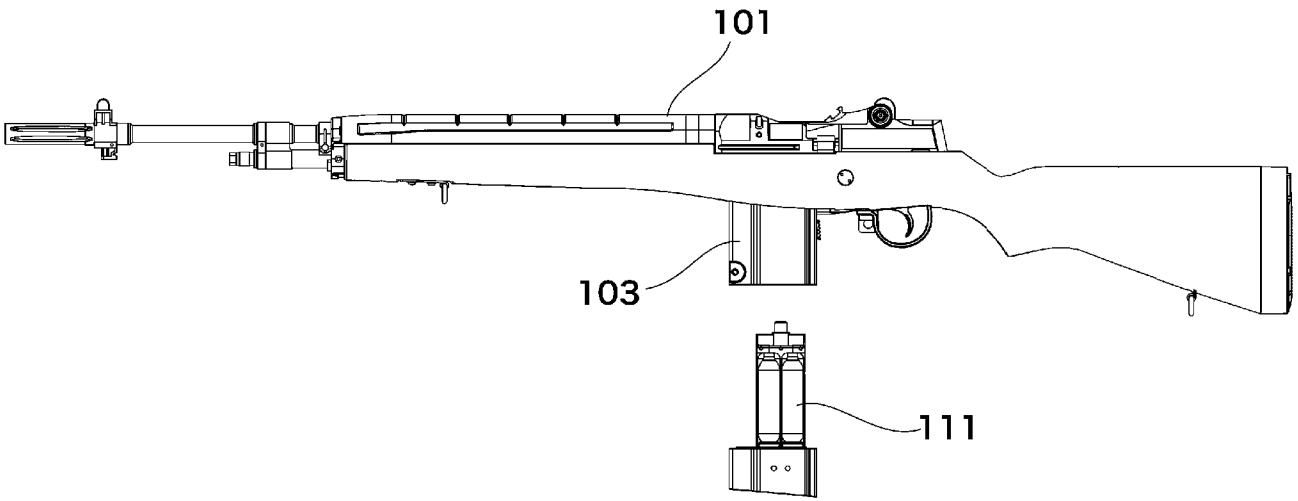
FIG.19 Related Art
FIG. 19 is a left side view of the toy gun gas cartridge loading device detached from the toy gun body in the related art.
Figure 20:
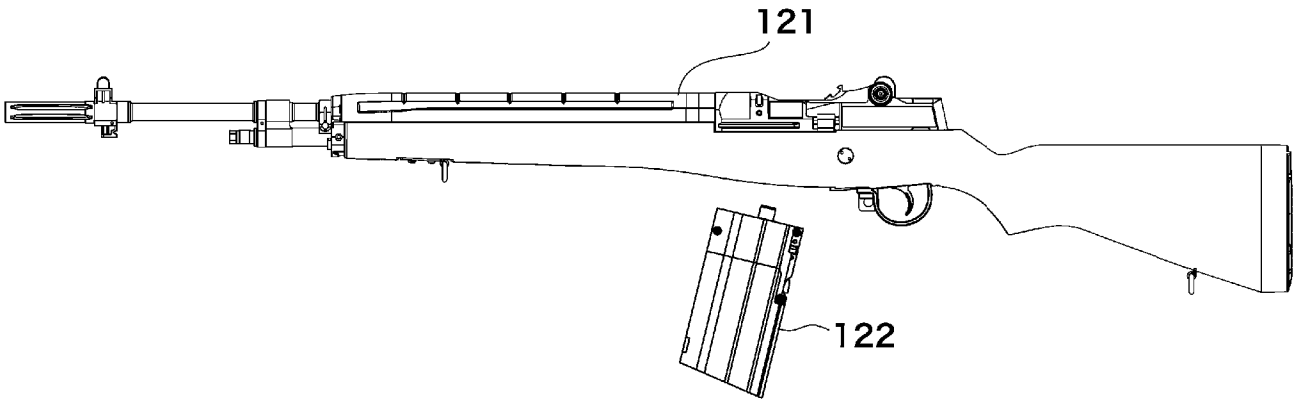
FIG.20 Related Art
FIG. 20 is a left side view of a real gun in the related art with a cartridge removed.
Figure 21:
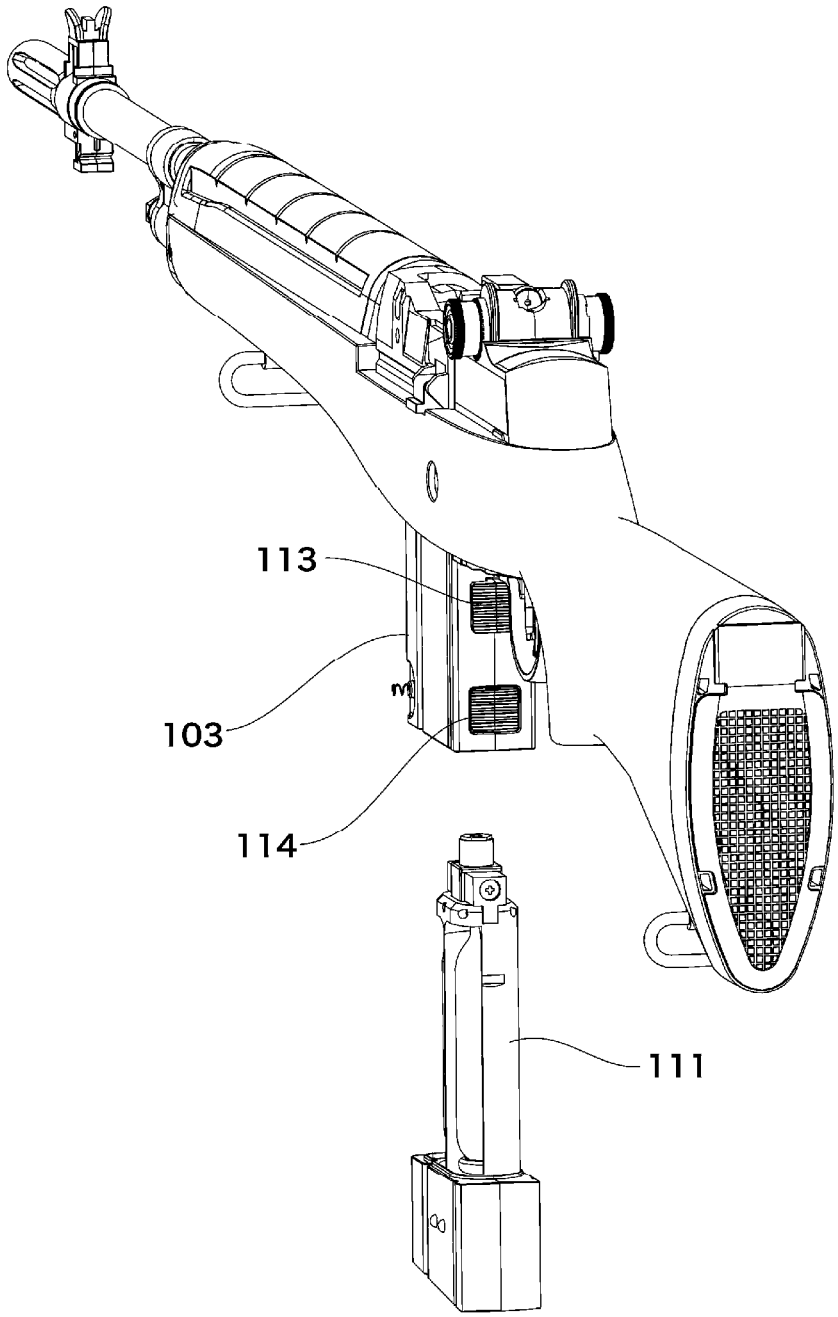
FIG.21 Related Art
FIG. 21 is a perspective view of the toy gun in the related art in which the toy gun gas cartridge loading device is detached from the toy gun body.

A reference numeral 35 denotes an operating pushing part. As shown in FIG. 15, the operating pushing part 35 penetrates the toy gun 11 and protrudes from the opposite side of the toy gun 11.

A reference numeral 36, which is shown in FIGS. 7 to 11, denotes an engaging part of the gun body first lock 31. A reference numeral 67, which is shown in FIG. 7 and FIGS. 9 to 11, denotes an engaging part of the loading device second lock 61.

Figure 9:
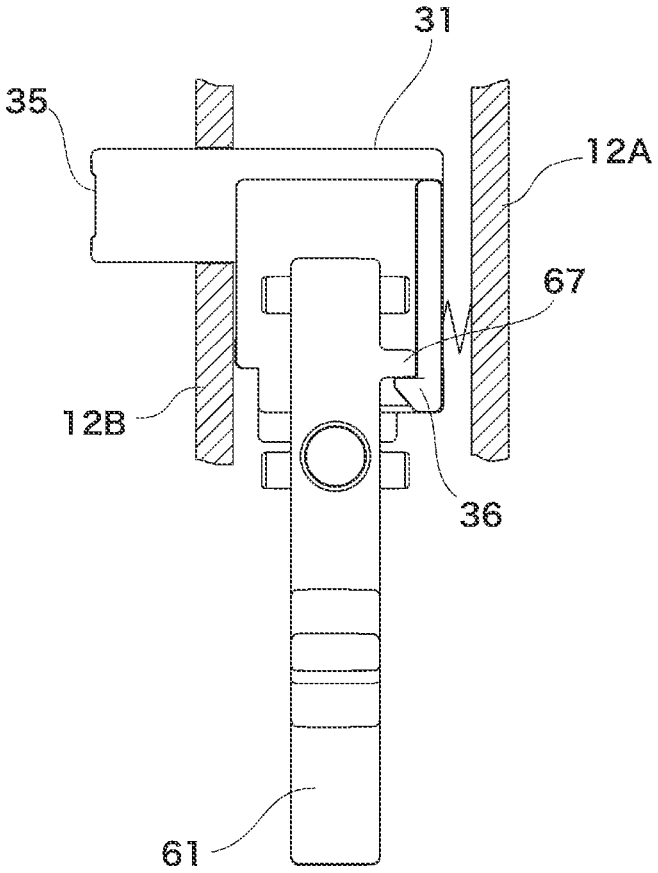
FIG. 9 is a fragmentary enlarged sectional view showing the relation between the gun body first lock and the loading device second lock according to the embodiment.

When the gun body first lock 31 and the loading device second lock 61 engage with each other, the engaging part 36 and the engaging part 67 engage with each other as shown in FIG. 9 so that the gun body first lock 31 and the loading device second lock 61 are locked with each other.

Figure 10:
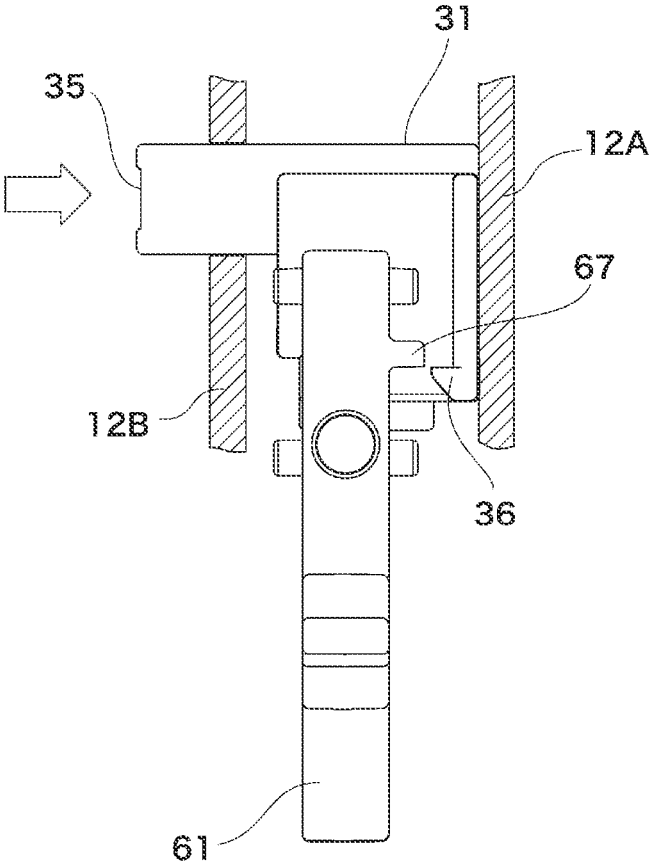
FIG. 10 is a fragmentary enlarged sectional view showing the relation between the gun body first lock and the loading device second lock according to the embodiment.
Figure 11:
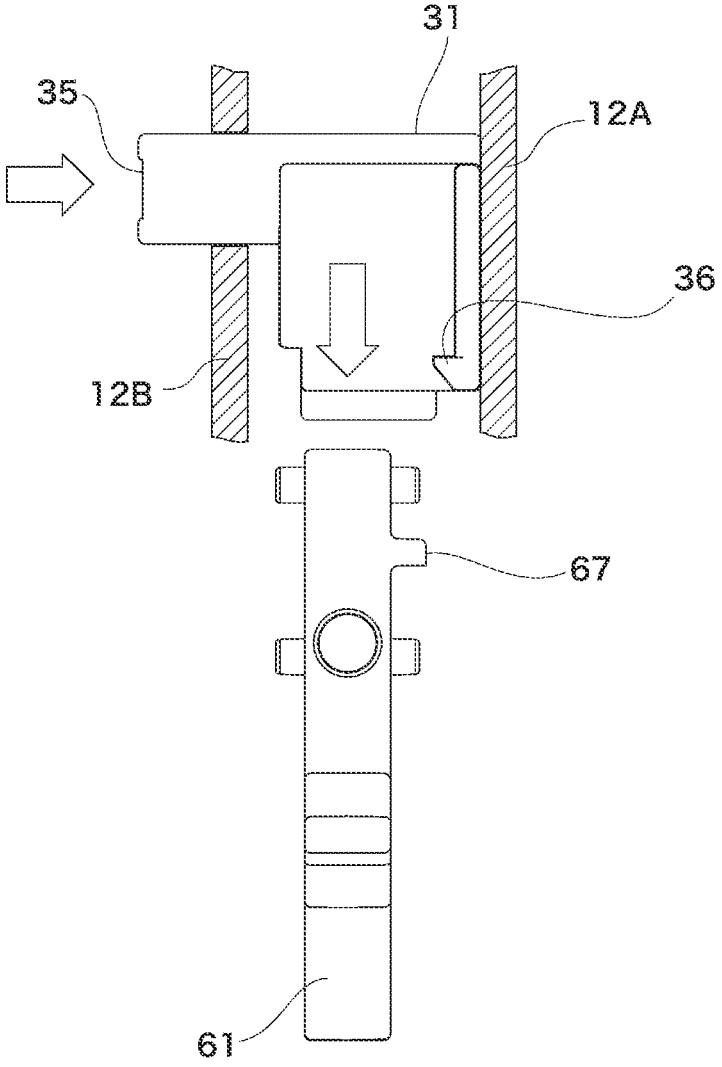
FIG. 11 is a fragmentary enlarged sectional view showing the relation between the gun body first lock and the loading device second lock according to the embodiment.

In order to disengage the loading device second lock 61 and the gun body first lock 31 from each other, the operating pushing part 35 of the gun body first lock 31 is pushed as shown in FIG. 10. By pushing the operating pushing part 35, the engaging part 36 and the engaging part 67 are disengaged from each other against the biasing force of the first lock spring 33. As a result of disengagement between the gun body first lock 31 and the loading device second lock 61, the toy gun gas cartridge loading device 41 including the loading device second lock 61 falls due to the gas pressure as shown in FIG. 11.

Figure 5:
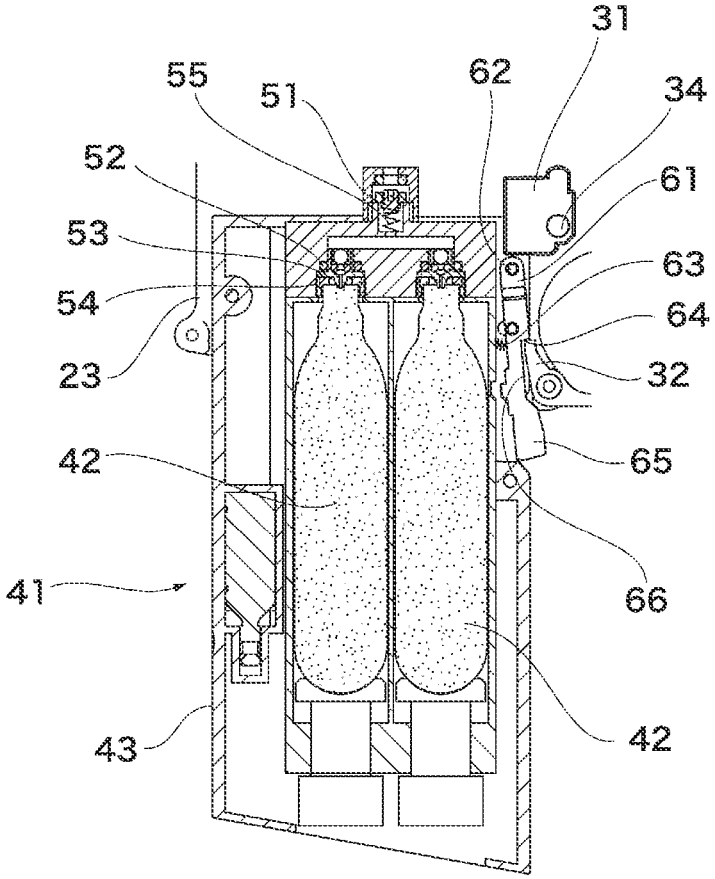
FIG. 5 is a left side sectional view of the toy gun gas cartridge loading device according to the embodiment, showing that the device attached to the toy gun body is being detached from the toy gun body.

FIG. 5 shows that the gun body second lock 32 and the toy gun gas cartridge loading device 41 engage with each other after the state shown in FIG. 4.

The loading device second lock 61 turns counterclockwise by the biasing force of the second lock spring 63 and the secondary lock 64 of the loading device second lock 61 engages with the gun body second lock 32 of the toy gun body 12. The lower portion of the gun body second lock 32 below its tip is housed in the gun body concave part 66.

Figure 13:
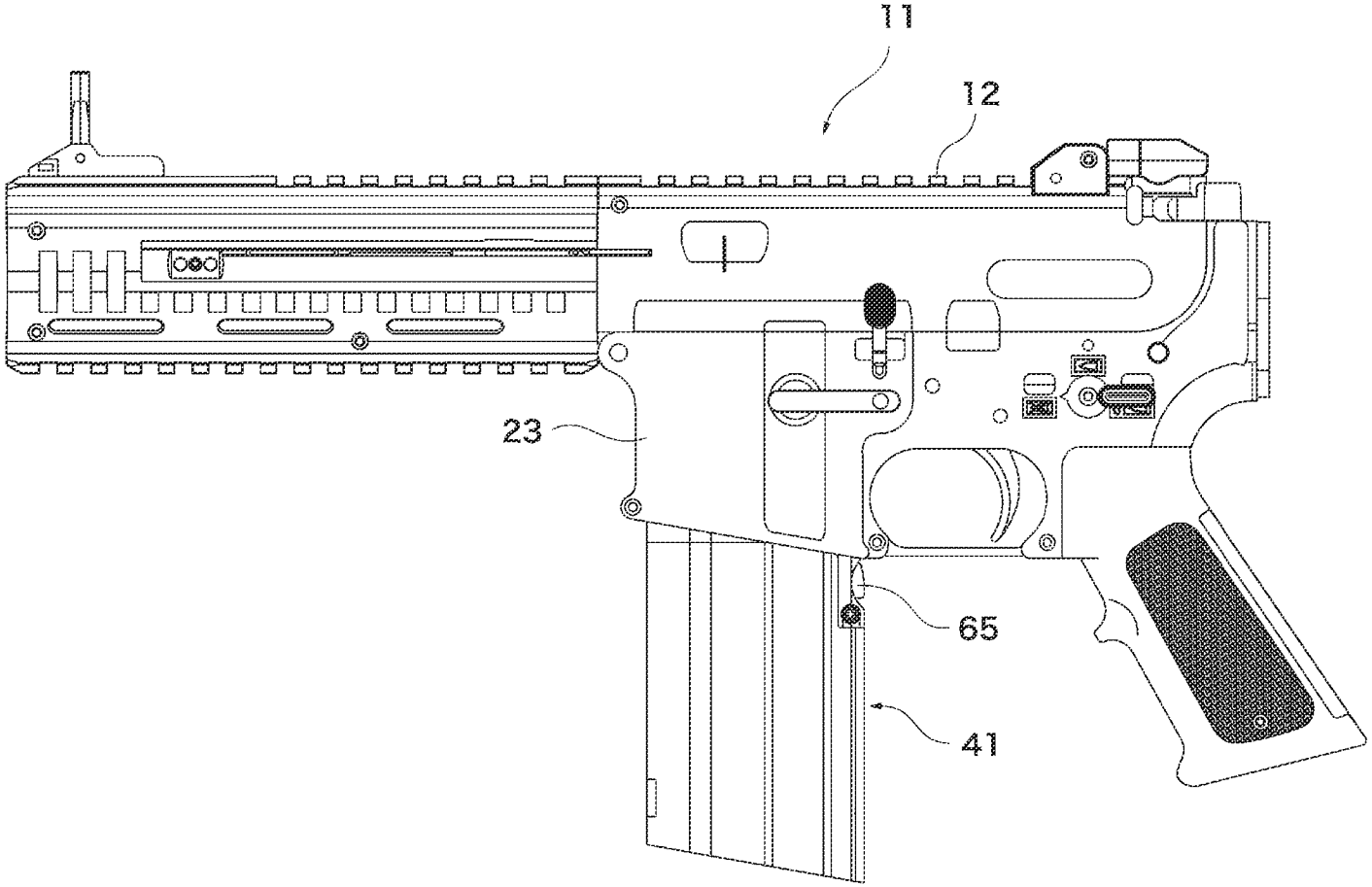
FIG. 13 a left side view of the toy gun in which the toy gun gas cartridge loading device attached to the toy gun body according to the embodiment is being detached.

Consequently the toy gun gas cartridge loading device 41 is once locked. The external appearance in this state is as shown in FIG. 13, in which the second lock operating part 65 is exposed to the outside of the loading device housing 23.

Figure 6:
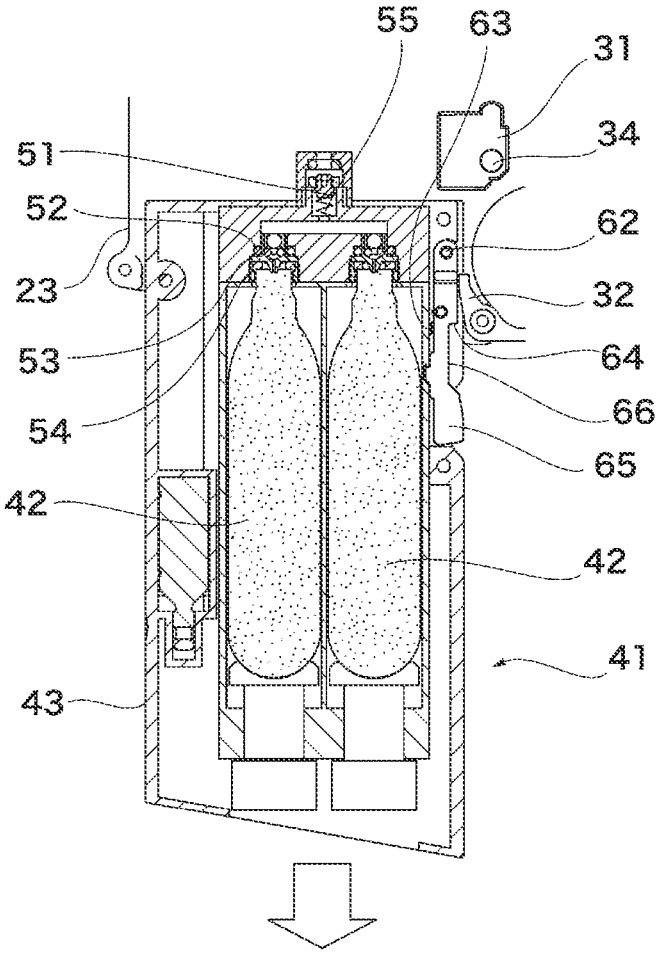
FIG. 6 is a left side sectional view of the toy gun gas cartridge loading device according to the embodiment, showing that the device attached to the toy gun body is being detached from the toy gun body.

FIG. 6 is a sectional view showing that the second lock operating part 65 has been just pushed toward the toy gun gas cartridge loading device 41.

When the second lock operating part 65 is pushed down toward the toy gun gas cartridge loading device 41, the gun body second lock 32 and the second lock 61 of the toy gun gas cartridge loading device 41 side disengage from each other and the gun body second lock 32 gets out of the gun body concave part 66, so that the toy gun gas cartridge loading device 41 can be detached from the toy gun 11.

Figure 12:
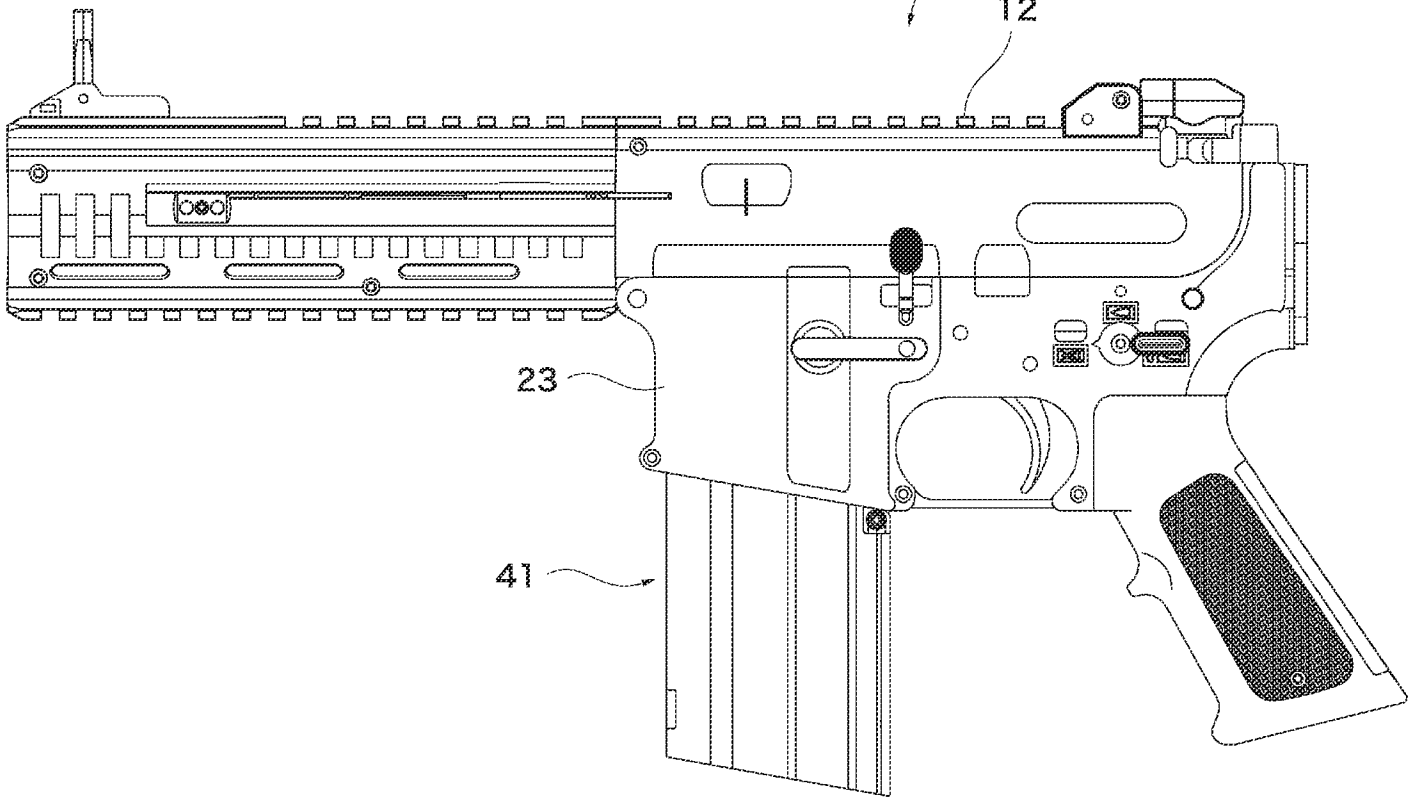
FIG. 12 is a left side view of the toy gun in which the toy gun gas cartridge loading device to according to the embodiment is attached to the toy gun body.
Figure 14:
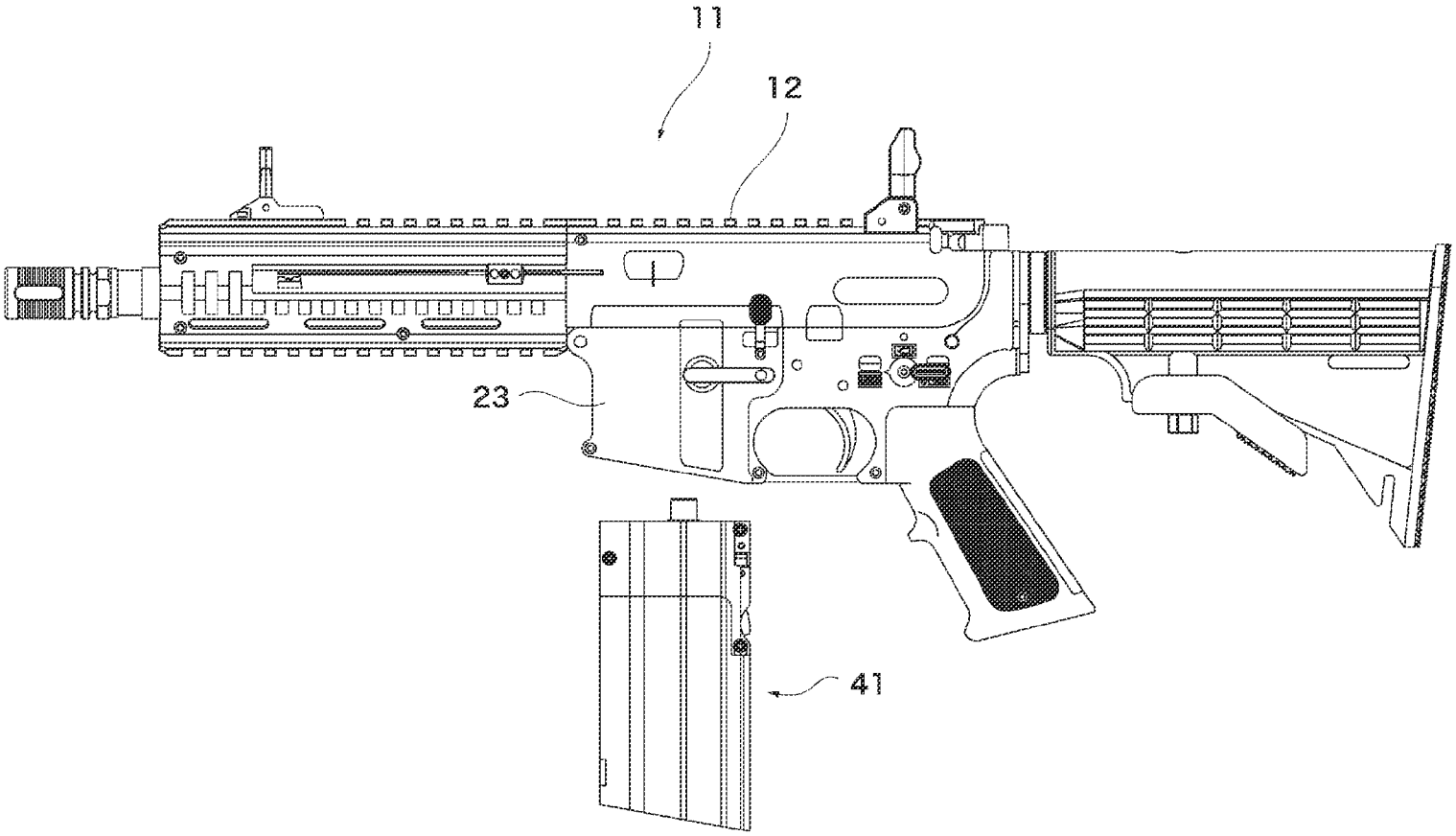
FIG. 14 is a left side view of the toy gun in which the toy gun gas cartridge loading device according to the embodiment is detached from the toy gun body.

As can be understood from FIG. 12 as an external side view of the toy gun 11 as an air gun using the toy gun gas cartridge loading device 41 according to the embodiment or FIGS. 14 and 15 showing the toy gun with the toy gun gas cartridge loading device 41 detached, the toy gun gas cartridge loading device 41 can be attached and detached in a similar way to the way the magazine of a real gun is attached and detached, increasing similarity to the real gun.

FIG. 12 is an external side view showing the toy gun body 12 to which the toy gun gas cartridge loading device 41 according to the embodiment is attached. FIG. 1 shows a cross section of what is shown in FIG. 12.

In this state, the second lock operating part 65 is hidden behind the toy gun 11. Unlike the toy guns in the related art, components which would not exist in a real gun are invisible from outside, so similarity to the real gun is increased.

FIG. 13 is an external view showing the gun body first lock 31 which has been just pushed down. FIG. 6 is a fragmentary sectional view of what is shown in FIG. 13.

Due to gas pressure, the toy gun gas cartridge loading device 41 begins moving down quickly and is going to get off of the toy gun body 12, but the second lock 32 of the toy gun body 12 engages with the secondary lock 64 of the second lock 61 of the toy gun gas cartridge loading device 41, so that the device 41 stops.

At this time, the second lock operating part 65 is exposed to the outside of the toy gun body 12 and becomes operable. The second lock operating part 65 is exposed only when it should be operated, so it is prevented from being operated by mistake.

In other words, this embodiment of the present invention employs a mechanism to take the following two steps: (1) As the user operates the gun body first lock 31, the toy gun gas cartridge loading device 41 moves down due to gas pressure and the second lock operating part 65 is exposed. At this time, the loading device second lock 61 and the gun body second lock 32 in the toy gun body 12 are locked with each other. (2) As the user operates the second lock operating part 65 of the loading device second lock 61, the toy gun body 12 and the toy gun gas cartridge loading device 41 are disengaged from each other and the toy gun gas cartridge loading device 41 can be detached from the toy gun 11.

Thus, the second lock operating part 65 of the loading device second lock 61 of the toy gun gas cartridge loading device 41 is arranged so that it is exposed to the outside of the toy gun 11 only when it should be operated as mentioned above.

In order to reattach the toy gun gas cartridge loading device 41 to the toy gun body 12, as shown in FIG. 1 the gun body first lock 31 and the lateral side of the toy gun gas cartridge loading device 41 are engaged with each other by being pushed, so that the toy gun gas cartridge loading device 41 and the toy gun body 12 are locked with each other.

The toy gun gas cartridge loading device 41 can be attached and detached as if the magazine of a real gun is attached and detached, so similarity to the real gun is increased.

The second lock operating part 65 is not exposed to the outside of the gun while the toy gun gas cartridge loading device 41 is attached to the toy gun 11. This also increases similarity to the design of the real gun and improves the commercial value of the air gun.

What is claimed is:

1. A toy gun comprising a toy gun body and a toy gun gas cartridge loading device to be attached to the toy gun body, wherein, the toy gun body comprising:

a gun body coupling valve for introducing compressed gas from outside and supplying the compressed gas into the toy gun body;

a loading device housing located around the gun body coupling valve;

a gun body first lock being located on an upper portion of the loading device housing and locked with the toy gun gas cartridge loading device when a toy gun side end of the toy gun gas cartridge loading device is inserted through an opening of the loading device housing for attachment to the toy gun body; and a gun body second lock being located under the gun body first lock, the toy gun gas cartridge loading device, housed in the loading device housing of the toy gun body when attached to the toy gun body, comprising:

a gas cartridge housed therein;

a loading device coupling valve being located at a tip of the toy gun gas cartridge loading device and adapted to be coupled to the gun body coupling valve of the toy gun body for attachment to the toy gun body; and a loading device lock adapted to housed in the loading device housing when the end of the toy gun gas cartridge loading device is housed in the loading device housing of the toy gun body, and located on a lateral side of the toy gun gas cartridge loading device and designed to be engaged with the gun body first lock and designed to be locked with the gun body second lock, wherein, the loading device lock is configured to engage with the gun body first lock when the toy gun gas cartridge loading device is housed in the loading device housing and is configured to disengaged with the gun body first lock when the gun body first lock is pushed;

the loading device lock is further configured to be engaged with the gun body second lock after the toy gas cartridge loading device slightly moves down when the lateral side of the toy gun cartridge loading device is disengaged from the gun body first lock;

the loading device lock is configured to be operable to be disengaged from the gun body second lock to detach the toy gun gas cartridge loading device from the toy gun body; and the gun body first lock is engaged and disengaged with an engaging part of the loading device lock and the gun body second lock is engaged and disengaged with a secondary lock of the loading device lock.

2. A toy gun gas cartridge loading device which is housed in a loading device housing of a toy gun body when attached to the toy gun body and houses a gas cartridge, comprising:

a loading device coupling valve being located at a tip of the toy gun gas cartridge loading device and adapted to be coupled to a gun body coupling valve of the toy gun body for attachment to the toy gun body; and a loading device lock adapted to housed in the loading device housing when the end of the toy gun gas cartridge loading device is housed in the loading device housing of the toy gun body, and located on a lateral side of the toy gun gas cartridge loading device and engaged with a gun body first lock and designed to be locked with a gun body second lock, wherein, the loading device lock is configured to engage with the gun body first lock when the toy gun gas cartridge loading device is housed in the loading device housing and is configured to disengage with the gun body first lock when the gun body first lock is pushed;

the loading device lock is further configured to be engaged with the gun body second lock after the toy gas cartridge loading device slightly moves down when the lateral side of the toy gun cartridge loading device is disengaged from the gun body first lock;

the loading device lock is configured to be operable to be disengaged from the gun body second lock to detach the toy gun gas cartridge loading device from the toy gun body; and the gun body first lock is engaged and disengaged with an engaging part of the loading device lock and the gun body second lock is engaged and disengaged with a secondary lock of the loading device lock.

* * * * *